United States Patent [19]

Murata

[11] 4,241,441

[45] Dec. 23, 1980

[54] ELECTRONIC TIMEPIECE

[75] Inventor: Mitsuhiro Murata, Tokyo, Japan

[73] Assignee: Citizen Watch Co., Ltd., Tokyo, Japan

[21] Appl. No.: 22,253

[22] Filed: Mar. 20, 1979

[30] Foreign Application Priority Data

Mar. 23, 1978 [JP] Japan ..... 53-033470

[51] Int. Cl.[3] ..... G04B 23/08; G04C 21/16; G04B 21/00; G04C 23/18

[52] U.S. Cl. ..... 368/247; 368/252; 368/259; 368/262; 368/267

[58] Field of Search ..... 58/57.5, 38 R, 152 B, 58/19 R, 21.11, 22.7, 16.5, 17, 18; 368/244, 247, 250, 259, 260, 267, 262

[56] References Cited

U.S. PATENT DOCUMENTS 3,728,855 4/1973 Preiser ..... 58/38 R

FOREIGN PATENT DOCUMENTS 2713221 9/1978 Fed. Rep. of Germany ..... 58/38 R

OTHER PUBLICATIONS

English Translation of German Patent DT 2713221 (translated from French equivalent).

*Primary Examiner*—J. V. Truhe
*Assistant Examiner*—John B. Conklin
*Attorney, Agent, or Firm*—Jordan and Hamburg

[57] ABSTRACT

An electronic timepiece having time indicating hands and an alarm time indicating hand which can be set to an alarm time within a range of twelve hours. Alarm time setting can be performed such that an alarm warning is produced the first time that alarm time coincidence is detected, and at subsequent times separated by 24 hour intervals, or such that the alarm warning is produced the second time that alarm time coincidence is detected, and at subsequent times separated by 24 hour intervals. Greater resolution for alarm time setting is achieved than for a timepiece in which the alarm time is set within a 24 hour range.

9 Claims, 4 Drawing Figures

ELECTRONIC TIMEPIECE

This invention relates to electronic timepieces having time indicating hands and an alarm function, and in particular to an electronic timepiece having an alarm function and in which an alarm time can be set within a range of twelve hours and can be set such that an alarm signal is subsequently produced only once in 24 hours, at the preset alarm time, either AM or PM.

A wide variety of digital type electronic timepieces, having a quartz crystal frequency standard, are presently available, many of which are equipped with an alarm function whereby an alarm signal can be emitted at a predetermined time. In the case of such a digital electronic timepiece, it is easy to arrange for detection of alarm time coincidence by means of electronic circuitry, and to control such circuitry by means of switches actuated from external operating members. In the case of an analog type electronic timepiece, however, external control of alarm time setting etc. is more difficult to implement. In general, the timepiece is required to emit an alarm signal once per day, i.e. once in each 24 hour period, at the preset alarm time. In some analog type electronic timepieces which have been available heretofore, the setting of alarm time has been performed by means of a mechanism which selects the alarm time from a range of 24 hours, i.e. the resolution of such a timepiece for alarm setting purposes is one in 24. The resolution for alarm time setting is therefore lower than for setting the current time. If, on the other hand, the alarm time is selected from within a 12 hour range, then it has been necessary heretofore to provide additional components to provide a mechanical arrangement whereby the alarm is only emitted within the desired 12 hour range, i.e. either AM or PM. This usually necessitates an additional mechanically coupled external operating member, to designate the preset alarm time as being either an AM time or a PM time. Such an arrangement leads to increased complexity of construction of the timepiece.

With an electronic timepiece in accordance with the present invention, the above disadvantages of previous designs of analog type timepieces having an alarm function are overcome. An alarm time can be preset within a 12 hour range, by rotating an alarm time indicating hand to the desired time and then actuating an external operating member, which produces an electrical signal serving to specify that an alarm signal will be emitted upon the next detection of coincidence between the preset alarm time and the current time, and at subsequent points in time separated by 24 hour intervals, or to specify that the alarm signal will be emitted on the second occasion that alarm time coincidence is detected thereafter, and at subsequent points in time separated by 24 hour intervals. Thus, with an electronic timepiece in accordance with the present invention, there is little increase in mechanical complexity caused by incorporation of the alarm function, while a high resolution for selection of the desired alarm time is provided.

It is therefore an object of the present invention to provide an improved electronic timepiece having time indicating hands and an alarm warning signal generating capability.

Further objects, features and advantages of the present invention may be clearly understood by reference to the following description together with the attached drawings, the scope of which is given by the appended claims.

Figure 1:
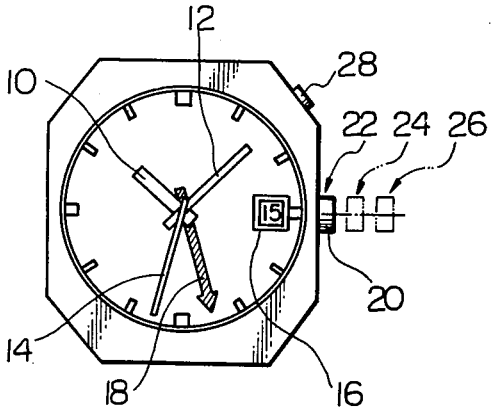
FIG. 1 is an external view of an electronic timepiece in accordance with the present invention.

Referring now to FIG. 1, an external view of an embodiment of an electronic timepiece in accordance with the present invention is shown therein. Numeral 10 denotes an hour hand, numeral 12 a minutes hand, and numeral 14 a seconds hand. The timepiece is also provided with an alarm time indicating hand 18, and a date display 16. Numeral 28 denotes an alarm control switch, which is used to set an alarm operating condition of the timepiece, as described hereinafter. Numeral 20 denotes a crown, which can be set to any of three positions, denoted by numerals 22, 24 and 26 respectively. In the first of these positions, 22, the timepiece functions in the normal operating mode. In the second position, 24, adjustment of the date displayed by date display 16, or of the alarm time shown by alarm time indicating hand 18 can be performed by rotating crown 20 in a clockwise direction or a counterclockwise direction, respectively. When crown 20 is in the third position, 26, the time shown by time indicating hands 10 and 12 can be adjusted.

Figure 2:
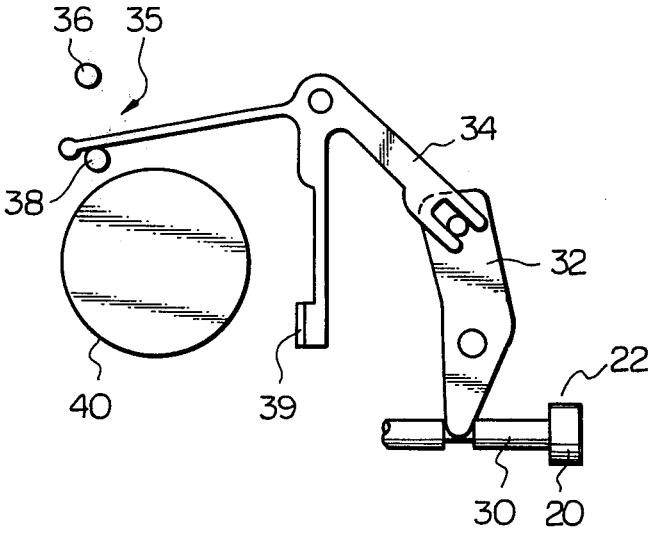
FIG. 2 is a partial view of a crown and switch operating mechanism in the electronic timepiece of FIG. 1.

FIG. 2 shows a mechanism which is coupled to crown 20, whereby electrical signals are produced in accordance with the position to which crown 20 is set. A stem 30 is rigidly connected to crown 20. A first lever 32 is engaged in a grooved portion of stem 30, and is thereby rotated when crown 20 is moved outward from the timepiece body. A second lever 34 acts in conjunction with first lever 32 and with a setting spring (which is not shown in the figure) in such a way as to determine the three positions 22, 24 and 26 of crown 20. Numeral 40 denotes a wheel which is braked by part 39 of lever 34 when crown 20 is in the third position, 26. For simplicity of description, the date correction mechanism, current time setting mechanism, etc., are omitted from FIG. 2.

Figure 3:
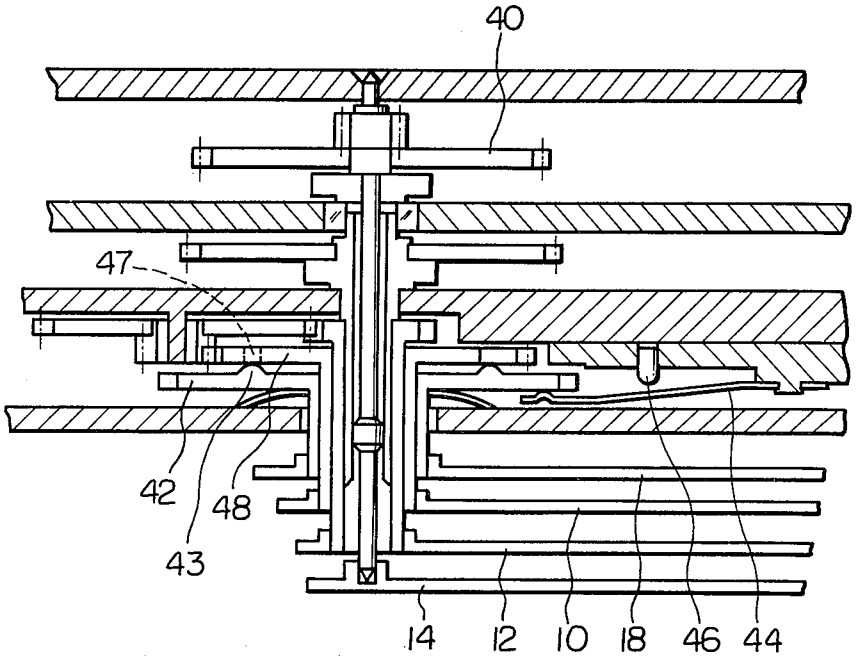
FIG. 3 is a partial cross-sectional view in elevation of time indicating hands and of an alarm time conicidence detection switch mechanism in the electronic timepiece of FIG. 1.

FIG. 3 is a partial cross-sectional view of certain essential parts of the timepiece shown in FIG. 1. Detection of coincidence between the current time, as indicated by hours hand 10, and a preset alarm time, as indicated by alarm time indicating hand 18, is performed by a mechanism comprising a wheel 42 having a protruding portions 43 which engage with recessed portions 47 of an hours wheel 48 when alarm time coincidence occurs, and further comprises a contact spring 44, a contact pin 46, etc. Alarm time indicating hand 18 is mounted on the wheel 42. When crown 20 is set to position 22 and is then turned clockwise, wheel 42 is rotated, so that a desired alarm time can be set. When coincidence between the alarm time and the current time occurs, contact spring 44 is placed in contact with contact pin 46, thereby generating an alarm detection signal as described hereinafter. This will occur once in every 12 hours.

A mechanism for driving wheel 42 in an interlocked relationship with crown 20 is also provided, which operates on a similar principle to the date and weekday correction mechanism of a conventional type of timepiece with time indicating hands. This mechanism is not shown or described herein. This mechanism can be arranged such that adjustment of the date is performed when the crown 20 is rotated counter-clockwise, and adjustment of the alarm time is performed when the crown 20 is rotated clockwise, or vice-versa.

Figure 4:
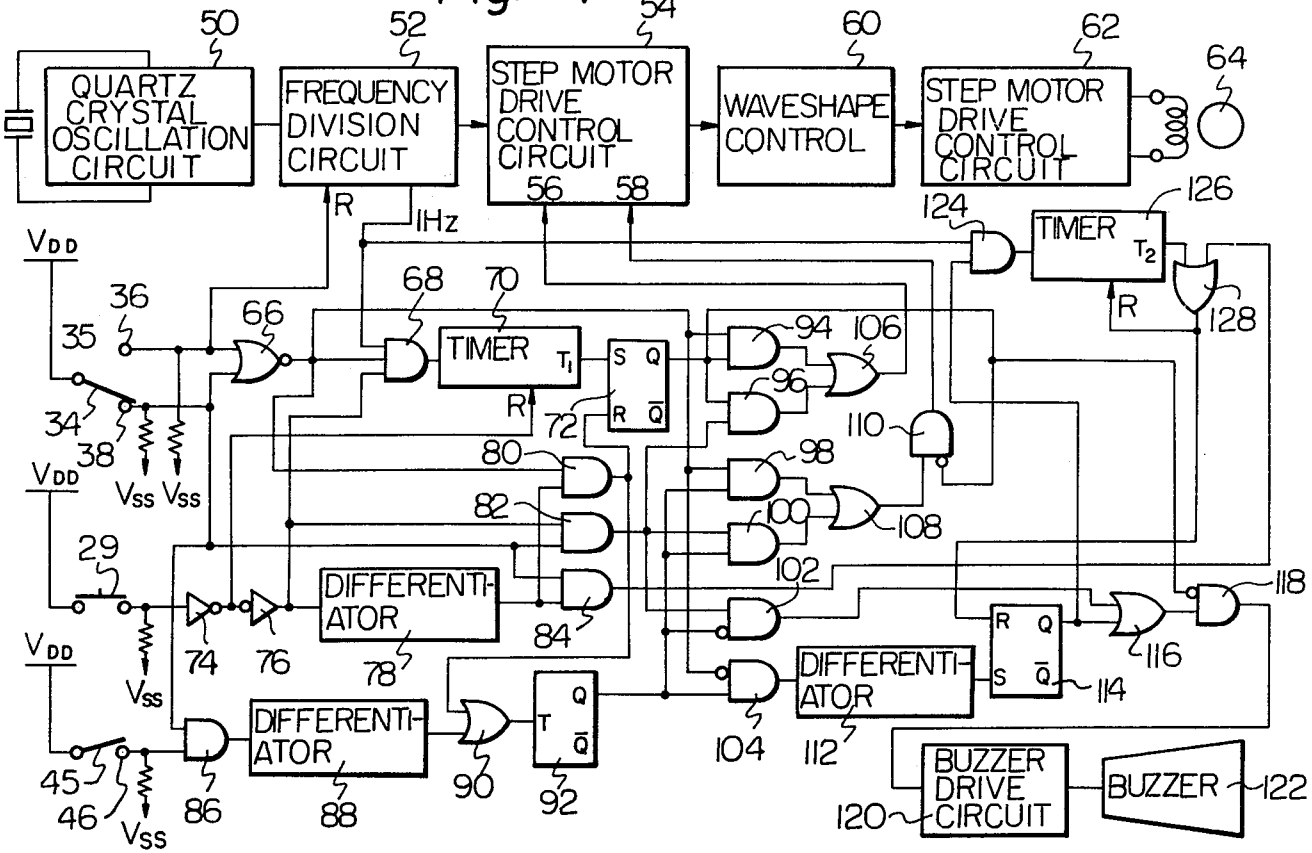
FIG. 4 is a general circuit diagram of an embodiment of an electronic timepiece in accordance with the present invention.

Referring now to FIG. 4, a circuit arrangement of the timepiece described above is shown therein. Numeral 50 indicates a quartz crystal oscillator circuit providing a high frequency standard frequency signal, which is applied to a frequency divder circuit 52. An output of frequency divider circuit 52 is applied to a motor drive control circuit 54, the output of which is applied to a waveshaping circuit 60. A drive input signal produced by waveshaping circuit 60 is applied to a motor drive circuit 62, which produces a drive signal causing a stepping motor 64 to be actuated, thereby driving time indicating hands 10, 12 and 14. As will be described hereinafter, motor drive control circuit 54 controls the drive signal applied to stepping motor 64 in such a way that the motion of seconds hand 14 is modulated to indicate the operating condition of the timepiece with respect to the alarm function.

Terminal pin 36, which forms part of the setting switch assembly 35 shown in FIG. 2, is connected to the reset terminal of frequency divider circuit 52. Terminal pin 38 is connected to one input of each of three AND gates 86, 82 and 84. Pins 36 and 38 are also connected to inputs of a NOR gate 66, the output of which is connected to one input of each of AND gates 80, 94 98 and 68., and also to the inhibit terminal of an inhibit-AND gate 104. A 1 Hz signal provided from frequency divider 52 is applied to a second input of AND gate 68, and the output of an inverter 76 is applied to a third input of AND gate 68. The output of AND gate 68 is coupled to the input of a timer circuit 70. Timer circuit 70 is arranged such that, when it is released from a reset condition, its output terminal goes from a low logic level potential (referred to herinafter as the L level) to a high logic level potential (referred to hereinafter as the H level) after a predetermined number of pulses have been applied to its input terminal from AND gate 68. The output terminal of timer 70 is connected to the set terminal of a flip-flop (designated hereinafter as FF) 72. The Q output terminal of FF 72 is applied to one input of each of AND gates 94 and 96, and to the inhibit terminals of inhibit-AND gates 110 and 118.

Alarm control switch 29 is connected to the input terminal of an inverter 74, such that actuation of alarm control switch 29 causes the output of inverter 74 to go from the H level to the L level. The output of inverter 74 is connected to there reset terminal of timer 70, and to the input of a second inverter 76. The output of inverter 76 is connected to a second input terminal of AND gate 68, and to the input of a differentiator circuit 78. The output of differentiator circuit 78 is applied to second input terminals of AND gates 80 and 84. The output of AND gate 80 is connected to the reset terminal of FF 72, and to one of the inputs to an OR gate 90.

The output of AND gate 82 is connected to one input each of AND gates 96 and 100, and to an input of inhibit-AND gate 102. The output of AND gate 84 is connected to one of the inputs of an OR gate 128.

Pin 46 of alarm detection switch 45 is connected to a second input of AND gate 86. The output of AND gate 86 is connected to the input of differentiator circuit 88, the output of which is connected to a second input terminal of OR gate 90. The output of OR gate 90 is connected to the toggle (T) terminal of a toggle-type flip-flop 92. The Q output of FF 92 is connected to second input terminals of AND gates 98 and 100 and of inhibit-AND gates 102 and 104. The output of inhibit-AND gate 102 is connected to one input of OR gate 116. The output of inhibit-AND gate 104 is connected to the input of a differentiator circuit 112. The output of differentiator 112 is connected to the set terminal of a set-reset type flip-flop 114, the Q output terminal of which is connected to one input of each of OR gates 116 and AND gate 124. The output of OR gate 116 is connected to an input of inhibit-AND gate 118. The output of inhibit-AND gate 118 is connected to the input of a buzzer drive circuit 120, which is coupled to drive a buzzer 80 which functions as an alarm device to provide an audible alarm warning signal.

The outputs of AND gates 94 and 96 are connected to the inputs of an OR gate 106, the output of which is connected to a control input terminal 56 of motor drive control circuit 54. The outputs of AND gates 98 and 100 are connected to inputs of an OR gate 108, the output of which is connected to an input of inhibit-AND gate 110. The output of inhibit-AND gate 110 is connected to a control input terminal 58 of motor drive control circuit 54.

A second input of AND gate 124 receives a 1 Hz signal from an output of frequency divider 52. The output of AND gate 124 is connected to an input of a second timer circuit 126. The output of timer circuit 126 is connected to one input of OR gate 128, the output of which is connected to the reset terminal of timer 126. The output of AND gate 84 is connected to a second input of OR gate 128.

The operation of the timepiece circuit of FIG. 4 will now be described. We shall first describe the operation when crown 20 is set to its second position, 24. In this condition, lever 34 does not contact either of contact pins 36 and 38. As a result, the output of NOR gate 66 is at the H level, thereby setting one input of each of AND gates 80, 94 and 98 to the H level. At this time, L level inputs are applied to all inputs of AND gates 82, 84 and 86. With the timepiece in this condition, if alarm control switch 29 is depressed, and kept depressed for a certain minimum period of time, the outputs of inverters 74 and 76 will remain at the L and H levels respectively for that time period. The reset status of timer circuit 70 is thereby released during this time period. After a certain number of 1 Hz pulses have been applied to timer 70 from the output of AND gate 68, the output of timer circuit 70 goes from the L level to the H level, thereby setting flip-flop 72. As described hereinafter, the Q output of FF 72 serves to establish an operative and an inoperative status of alarm device 122. When FF 72 is set, so that the Q output of this flip-flop is at the H level, inhibit-AND gate 118 acts to inhibit alarm device 122 from being actuated. In addition, when the Q output of FF 72 goes to the H level, the output of AND gate 94, and hence the output of OR gate 106 goes to the H level. As a result, motor drive control circuit 54 controls the timing of the drive input pulses applied to drive circuit 62 such that the seconds hand 14 is advanced by motor 64 at a rate of four immediately consecutive steps, occurring once in every four seconds. Since the seconds hand 14 is normally advanced at a rate of one step per second, it will be apparent that motor drive control circuit 54 serves to modulate the motion of seconds hand 14 in such a way as to clearly indicate that the alarm device 122 has been set to the inoperative condition, when this inoperative condition is established. This condition of advancement of the seconds hand will be designated hereinafter as the 4-seconds advancement mode.

After this 4 seconds advancement mode has been established, if alarm control switch 29 is released and then depressed again for a brief time interval, an output pulse of short duration will be produced by differentiator circuit 78, causing a corresponding output pulse to be produced by AND gate 80. This output pulse resets FF 72, so that the operative condition of alarm device 122 is established. The output pulse from AND gate 80 is also applied to the toggle input terminal of toggle type flip-flop 92, through OR gate 90. Thus, each time that alarm control switch 29 is actuated, the output Q of FF 92 changes from the H level to the L level, or vice-versa, if switch 29 is only actuated briefly. The Q output of FF 92 serves to establish two conditions of the timepiece. One of these is a first alarm condition, in which an alarm signal will be generated by alarm device 122 the first time that coincidence occurs between the current time and the preset alarm time, causing alarm detection switch 45 to generate an alarm detection signal, and at subsequent points in time separated by 24 hour intervals, when the alarm detection signal is again generated. The other condition which is controlled by FF 92 is a second alarm condition, in which an alarm signal is generated by alarm device 122 the second time that an alarm detection signal is generated by alarm detection switch 45, and at subsequent points in time separated by 24 hour intervals, when the alarm detection signal is again generated.

For the embodiment of FIG. 4, the first alarm condition is in force when the Q output of FF 92 is at the L level, and the second alarm condition is in force when the Q output of FF 92 is at the H level. If for example, the timepiece is in the second alarm condition, so that the Q output of FF 92 is at the H level, then the output of AND gate 98 will also be at the H level, causing the output of OR gate 108 to be at the H level. If FF 72 is in the reset status at this time, so that alarm device 122 is operative, then the output of inhibit-AND gate 110 will also be at the H level, causing an H level input to be applied to control input 58 of motor drive control circuit 54. This causes motor drive control circuit 54 to control the drive input signal applied to motor drive circuit 62 such that the seconds hand 14 of the timepiece is advanced by two immediately consecutive steps occurring once in every two seconds. This will be referred to hereinafter as the 2-seconds advancement mode. It will be apparent that, so long as FF 72 is in the set condition, so that alarm device 122 is inoperative, the output of inhibit-AND gate 110 will be held at the L level, and the timepiece will be maintained in the 4-seconds advancement mode of the seconds hand 14. In this case, the output of AND gate 94 and of OR gate 106 will be held at the L level.

In order to set the timepiece in either the first or second alarm condition, the user first pulls out the crown 20 to the second position 24. If it is assumed that the Q output of FF 92 is at the H level at this time, so that the second alarm condition is in force, then this will be indicated by the seconds hand 14 advancing in the 2-seconds advancement mode. In order to establish the second alarm condition, the user simply depresses alarm control switch 29 for a brief period. This causes an output pulse to be produced by differentiator circuit 88, but does not cause a change in the output of timer circuit 70. A pulse is therefore output from AND gate 80, causing a pulse to be applied from the output of OR gate 90 to the toggle input of FF 92. The Q output of FF 92 therefore goes to the L level, so that the first alarm condition is established. This is indicated to the user by the seocnds hand 14 being advanced at the normal rate, i.e. one step per second. The user then replaces crown 20 in the first position, 22.

Similarly, in order to change the timepiece from the first alarm condition to the second alarm condition, the procedure described above is performed. It is of course possible to actuate the alarm control switch by an odd number of actuations, rather than by a single actuation, to achieve a changeover from one alarm condition to the other.

It should be noted that, while the crown 20 is pulled out into the second position 24, an L level input is applied to AND gate 86 from terminal pin 38 of setting enable switch 35. If an alarm detection signal is produced by alarm detection switch 45 during the process of changing from one alarm condition to the other, therefore, this signal is not outpt by AND gate 86, and therefore is not applied to FF 92.

The operation of the timepiece circuit when crown 20 is set to the first position 22 will now be described. In this state, lever 34 is in contact with contact pin 38, so that the output of NOR gate 66 is at the L level. This causes both of control inputs 56 and 58 of motor drive control circuit to be held at the L level, so that the timepiece operates in the normal advancement mode of seconds hand 14, i.e. one step per second. However, it is possible for the user to determine the alarm time condition by depressing alarm control switch 29. This causes the output of AND gate 82 go to the H level, thereby enabling AND gates 96 and 100, and also inhibit-AND gate 102. Thus, if the output of FF 72 is at the H level, so that alarm device 122 is inoperative, then the output of AND gate 96, and therefore the output of OR gate 106, will go to the H level. The H level input thereby applied to control input 56 of motor drive control circuit 54 will cause the 4-seconds advancement mode of seconds hand 14 to be entered. This indicates to the user that the timepiece is in the alarm inoperative condition.

If, on the other hand, the timepiece is in the alarm operative condition, so that the Q output of FF 72 is at the L level, and if the Q output of FF 92 is at the H level, so that the second alarm condition is in force, then when alarm control switch 29 is depressed, the output of AND gate 100 will go to the H level, since H level inputs are applied to this gate from the Q output of FF 92 and from AND gate 82. The output of OR gate 108 therefore goes to the H level, so that motor drive control circuit 54 causes the 2-seconds advancement mode of seconds hand 14 to occur.

If the timepiece is in the alarm operative condition, and in the first alarm condition, then the output of FF 92 will be at the H level. When the alarm control switch 29 is depressed in this condition, then the H level output which results, from the output of AND gate 82, causes the output of inhibit-AND gate 102 to go to the H level. As a result, an H level output is applied from OR gate 116 to inhibit-AND gate 118, thereby causing alarm device 122 to be actuated. An audible alarm signal is therefore generated to indicate to the user that the timepiece is in the alarm operative condition and in the first alarm condition. This is also indicated by the fact that the seconds hand 14 continues to be advanced at a rate of one step per second.

Thus, without pulling out the timepiece crown 20, the user can learn the alarm condition of the timepiece, and whether the alarm is in an operative state or not, simply be depressing the alarm control switch 29 while timepiece is in the normal operating condition.

The way in which alarm device 122 is actuated will now be described. With the timepiece in the normal operating condition (i.e. with crown 20 in the first position 22), an H level input is applied from contact pin 38 of setting enable switch 35 to AND gate 86. Thus, each time that coincidence between the current time and the present alarm time occurs (after the timepiece has been placed in the normal operating condition), the output of AND gate 86 goes to the H level in response to the alarm detection signal produced by alarm detection switch 45. A pulse is therefore produced by differentiator circuit 88, and applied through OR gate 90 to the toggle terminal of FF 92. We shall first assume that the timepiece is in the first alarm condition (so that the Q output of FF 92 is at the L level) and in the alarm operative condition (so that the Q output of FF 72 is at the L level). The pulse applied to the toggle terminal of FF 92 causes the Q output of FF 92 to go from the L level to the H level. At this time, an L level input is being applied to the inhibit terminal of inhibit-AND gate 104 from the output of NOR gate 66. An H level output therefore is produced by inhibit-AND gate 104, causing a pulse to be produced by differentiator circuit 112. This pulse sets FF 114, so that an H level output is applied from the Q output of FF 114 to the input of inhibit-AND gate 118. An H level input is therefore applied to buzzer drive circuit 120, causing alarm device 122 to generate an audible alarm warning signal.

When the Q output of FF 114 goes to the H level, this enables 1 Hz pulses to be applied to the input of timer circuit 126 from the output of AND gate 124. After a predetermined number of these 1 Hz pulses have been applied, the output T2 of timer circuit 126 goes to the H level. The output of OR gate 128 therefore goes to the H level, thereby resetting timer 126, and at the same time resetting FF 114, so that the Q output of FF 114 no longer causes alarm device 122 to be actuated, and the audible alarm signal is halted. Timer 126 therefore serves to determine the duration of the aduible alarm signal which is generated when alarm time coincidence is detected.

FF 92 is now in the set condition, so that its Q output is at the H level. The next time that alarm coincidence is detected, causing an alarm detection signal to be produced by alarm detection switch 45, a pulse will again be produced by differentiator circuit 88 and applied to the toggle input of FF 92 from OR gate 90. The Q output of FF 92 will therefore go from the H level to the L level. However, since differentiator circuit 112 is designed such that it will only produce an output pulse in response to an L level to H level transition at its input, no pulse will be produced by differentiator circuit in response to the H level to L level transition at the output of inhibit-AND gate 104 occurring at this time.

Subsequently, when an alarm detection signal is again produced by alarm detection switch 45 (after an interval of 12 hours from the second detection of alarm time coincidence), since the Q output of FF 92 goes from the L level to the H level, a pulse is produced by differentiator circuit 112. This pulse sets FF 114, so that an audible alarm signal is again generated by alarm device 122 for a predetermined period of time, by the process described previously.

Thus, if the timepiece is set to the first alarm condition, and then placed in the normal operating condition by setting the crown 20 to the first position 22, an alarm signal will be generated the first time alarm coincidence is detected after the timepiece has been placed in the normal operating condition. Thereafter, alarm signals will again be generated at subsequent points in time which are separated by 24 hour time intervals. If, for example, an alarm time of 7 o-clock and the first alarm condition are established, when the current time is 6 AM, then an alarm signal will be produced at 7 AM on the same day, at 7 AM the next day, and so on.

If on the other hand the second alarm condition is established, and the timepiece then placed in the normal operating condition, then the Q output of FF 92 will be at the H level after the normal operating condition has been entered. Thereafter, the first time that alarm coincidence is detected, so that a pulse is applied from the output of OR gate 90 to the toggle input of FF 92, the Q output of FF 92 will go to the L level. No pulse will be produced by differentiator circuit 112 at this time, as explained above. When the next alarm coincidence is detected, so that an alarm detection signal is produced by alarm detection switch 45, then the Q output of FF 92 will go from the L level to the H level. A pulse will thereby be output from differentiator 112 which will set FF 114, causing an audible alarm signal to be generated by alarm device 122. 24 hours later, an audible alarm signal will again be generated by alarm device 122, and so on at subsequent points in time separated by 24 hour intervals.

Thus, for example, if an alarm time of 7 o-clock and the second alarm condition are established, with crown 20 in position 24, and if crown 20 is then returned to the normal operating position, i.e. position 22, when the current time is 6 AM, then an audible alarm signal will subsequently be generated at 7 PM of the same day, at 7 PM on the next day, and so on.

Thus, the timepiece user can select an alarm time within a range of 24 hours, by selecting either the first or the second alarm condition as required by the current time when the alarm time selection is performed. An alarm time can therefore be easily and accurately set, withing a range of 12 hours, with a timepiece arrangement which is simple and economical to manufacture. In addition, the timepiece user can identify whether the timpiece is in the alarm inoperative condition, in which no audible signal will be generated, in the first alarm condition, or in the second alarm condition, simply by depressing the alarm control switch 29, when the timepiece is in the normal operating status. Since the indication of the alarm time condition and the alarm operative/inoperative condition are provided by means of the seconds hand of the timepiece and by the alarm device 122, it is unnecessary to incorporate additional components in the time-piece to provide such indications. The cost of manufacture of such an electronic timepiece need not therefore be substantially greater than that of a conventional type of electronic timepiece of analog type which does not have an alarm function.

In the embodiment of the present invention described above, the timepiece can only be set to the first or second alarm condition when the crown 20 has been pulled out to the second position, 24. Thus, during normal operation of the timepiece, when the crown is in position 22, accidental changing of the alarm condition cannot occur.

Although in the above embodiment, the user must actuate the alarm control switch 29 after crown 20 has been placed in position 24, in order to set the timepiece to either the first alarm condition or the second alarm condition, it is also possible to arrange the timepiece configuration such that the first (or second) alarm condition is forcibly established when the crown 20 is pulled out to position 24.

It should also be noted that, although both visible and audible indication means are provided for discriminating between the first and second alarm conditions, it is equally possible to utilize only one or the other of such means to provide the desired indication.

In the embodiment described above, also, AND gate 86 is inhibited from applying a detection signal to differentiator circuit 88, and thereby generating an audible alarm warning, when crown 20 is in position 24 or in position 26, i.e. when setting of the current time indication or of the alarm time indication is being performed. Thus, if the hours hand 10 is brought into coincidence with the position of the alarm time indicating hand 18 while setting is being performed, no audible alarm signal is generated. It is however possible to modify the circuit arrangement of FIG. 4 such that, when the time indicated by hours hand 10 and by alarm time indicating hand 18 coincide while setting of the alarm time or of the current time indication is being performed, an audible alarm signal is generated for a brief period of time. Such an arrangement can facilitate the process of setting an alarm time, by providing audible confirmation of the relationship between the positions of hours hand 10 and alarm time indicating hand 18.

Thus, although the present invention has been shown and described with respect to a particular embodiment, it should be noted that various changes and modifications to this embodiment are possible, which fall within the scope claimed for the present invention.

What is claimed is:

1. An electronic timepiece, comprising:

a source of a standard time signal;

motor drive circuit means responsive to said standard time signal for producing a drive signal;

a motor coupled to receive said drive signal;

a time indicating mechanism driven by said motor to display current time within a range of twelve hours;

alarm time indicating means for indicating a preset alarm time within said range of twelve hours;

alarm time setting means coupled to said alarm time indicating means for setting a desired alarm time;

alarm detection switch means coupled to said alarm time indicating means and to said time indicating mechanism for detecting coincidence between said alarm time and said current time, and responsive to said detection for producing an alarm detection signal;

alarm circuit means coupled to receive said alarm detection signal;

alarm control means coupled to said alarm circuit means for selectively establishing a first alarm condition in which said alarm circuit means is responsive to the first and subsequent odd-numbered occurrences of said alarm detection signal after said first alarm condition has been established, for generating an alarm actuation signal, and a second alarm condition in which said alarm circuit means is responsive to the second and subsequent even-numbered occurrences of said alarm detection signal after said second alarm condition has been established, for generating said alarm actuation signal;

an alarm device responsive to said alarm actuation signal for generating an audible alarm warning signal; and discrimination means for enabling said first alarm condition and said second alarm condition to be distinguished by the user.

2. An electronic timepiece according to claim 1, wherein said alarm circuit means further produces a first discrimination signal when said first alarm condition is established and produces a second discrimination signal when said second alarm condition is established.

3. An electronic timepiece according to claim 2, in which said time indicating mechanism comprises a seconds hand, and further comprising drive control circuit means coupled between said source of a standard time signal and said drive circuit means, responsive to said standard time signal and said first and second discrimination signals for producing a modulated drive signal which is applied to said drive circuit means to modulate the motion of said seconds hand of said time indicating hands, whereby visible discrimination of said first and said second alarm conditions is provided.

4. An electronic timepiece according to claim 1, wherein said alarm control means comprises alarm control switch means coupled to an external actuating member, for producing an alarm condition setting signal each time said external actuation member is actuated.

5. An electronic timepiece according to claim 4, in which said alarm circuit means comprises a toggle type flip-flop responsive to said alarm detection signal and said alarm condition setting signal.

6. An electronic timepiece according to claim 5, in which said alarm circuit means generates said alarm actuation signal in response to a change from a reset state to a set of said toggle type flip-flop.

7. An electronic timepiece according to claim 4, wherein said alarm control means further comprises:

setting enable switch means coupled to an external operating member for producing first control signals when said external operating member is operated to a first position and for producing second control signals when said external operating member is operated to a second position; and gate means connected to said alarm control switch means and said setting enable switch means for passing said alarm condition setting signal to said alarm circuit means in response to one of said first and second control signals.

8. An electronic timepiece according to claim 7, and further comprising:

control gate means coupled to said alarm detection switch means and said setting enable switch means for passing said alarm detection signal to said alarm circuit means in response to one of said first and second control signals;

a toggle-type flip-flop having an input terminal coupled to an output terminal of said control gate means and responsive to successive occurrences of said alarm detection signal when said first control signals are being produced by said setting enable switch means and responsive to successive occurrences of said alarm condition setting signal when said second control signals are being produced by said setting enable switch means, for producing an output signal which is alternately at a first logic level potential and at a second logic level potential;

differentiator circuit means responsive to said output signal from said toggle-type flip-flop for generating a pulse when said output signal goes from said first logic level potential to said second logic level potential;

a set/reset flip-flop circuit having a set terminal coupled to receive said pulse from said differentiator circuit for thereby producing an output signal at a first logic level potential;

inhibit gate means responsive to said first control signals from said setting enable switch means and to said first logic level potential of said signal from said set/reset flip-flop circuit for producing said alarm actuation signal;

first gate means coupled to receive a train of low frequency pulses from said source of a standard time signal and responsive to said first logic level potential of said set/reset flip-flop circuit output for passing said train of low frequency pulses to an output terminal thereof;

timer circuit means coupled to receive said train of low frequency pulses from said first gate means, for producing an output signal at a first logic level potential when a predetermined number of said low frequency pulses have been received, said output signal being applied to a reset terminal of said set/reset flip-flop for causing said output of said set/reset flip-flop to go to a second logic level potential; and second gate means coupled to receive said output signal from said timer circuit means and having an output terminal coupled to a reset terminal of said timer circuit means, whereby said timer circuit means is reset to an initial condition when said output signal of said timer circuit means goes to said first logic level potential.

9. An electronic timepiece according to claim 3, and further comprising audible alarm control circuit means coupled between said alarm control switch means and said alarm device, responsive to said first and second discrimination signals when said alarm control switch is actuated for driving said alarm device, whereby audible discrimination of said first and said second alarm conditions is provided.

* * * * *